United States Patent [19]

Yanagimoto et al.

[11] 4,074,557

[45] Feb. 21, 1978

[54] METAL EXTRUSION PROCESS WITH HIGH REDUCTION

[75] Inventors: Samon Yanagimoto, Kodaira; Koshiro Aoyagi; Susumu Mizunuma, both of Kitakyushu; Kouki Nambu, Nohgata, all of Japan

[73] Assignee: Nippon Steel Corporation, Tokyo, Japan

[21] Appl. No.: 736,182

[22] Filed: Oct. 27, 1976

[30] Foreign Application Priority Data

| | | |
|---|---|---|
| Oct. 30, 1975 | Japan | 50-131061 |
| Nov. 5, 1975 | Japan | 50-133314 |

[51] Int. Cl.[2] ..... B21B 15/00

[52] U.S. Cl. ..... 72/206; 72/224; 72/256; 72/278

[58] Field of Search ..... 72/256, 206, 224, 225, 72/250, 252, 253, 199, 278, 256

[56] References Cited

U.S. PATENT DOCUMENTS

| | | | |
|---|---|---|---|
| 376,222 | 1/1888 | Allderdice | 72/224 |
| 723,834 | 3/1903 | Cooper | 72/250 |
| 888,299 | 5/1908 | Benjamin | 72/224 |
| 1,513,565 | 10/1924 | Somersall | 72/224 X |
| 2,057,580 | 10/1936 | Layton | 72/224 X |
| 3,360,974 | 1/1968 | Purvance | 72/224 |
| 3,391,561 | 7/1968 | Calmes | 72/206 X |

*Primary Examiner*—Milton S. Mehr

*Attorney, Agent, or Firm*—Wenderoth, Lind & Ponack

[57] ABSTRACT

A metal extrusion process with high reduction wherein a metal blank is extruded from a container through an opening which is formed by a plurality of work rolls. The metal blank is guided to the opening from the outlet of the container by causing the metal blank to adapt to the shape of the opening by means of a forming die so that the metal blank does not overfill the opening. This extrusion process is capable of forming the metal blank into a product having the desired cross section with high elongation in one pass and also the radius of curvature of the corner portion of the product can be freely adjusted.

6 Claims, 39 Drawing Figures b/a>0 b/a=0 b/a<0 b/a>0 b/a=0 b/a<0 v/V=0.9 v/V=1.0 v/V=1.2
UNDERFILL AMOUNT AT THE CORNER
MID POINT OF M-M'
MID POINT OF N-N'
MID (POINT OF N-N')

(S3-S3)

(S2-S2)

(S1-S1)

(S4-S4)

(S5-S5)

METAL EXTRUSION PROCESS WITH HIGH REDUCTION

BACKGROUND OF THE INVENTION

This invention relates to a metal extrusion process to be used for forming a metal blank into a plate or a formed metal shape having one of a variety of cross sections.

Heretofore, in rough rolling of billets or shapes the total elongations of which are 4 – 7 times the original length, the metal has been rolled in 6 – 10 passes in one reversing mill. However, this reverse rolling system has low productivity and also the temperature drop in the rolled metal during the rolling operation is large, which factors are drawbacks of the reverse rolling system. Lately, in order to improve the productivity of rolling operations, a process for continuously rolling the rolled metal by a continuous rolling installation wherein 6 – 10 stands of rolling mills are disposed in series has been widely employed. With this process, it is possible to eliminate the drawbacks of the reverse rolling system, but a longer line is required and the installation becomes large in size, and it invites the problems of replacement of rolls and adjustments and maintenance, etc. Under the circumstances, in order to eliminate the foregoing drawbacks, special mills such as a planetary cross rolling mill or a swing forging mill have been developed.

These special mills have a complicated structure and are disadvantageous from the standpoint of maintenance in many respects, and also the cross section of the product becomes more less angular in shape which is not necessarily acceptable and moreover the surface skin shows spiral patterns. These are some of the various problems encountered, and make such special mills far from satisfactory.

An extrusion process which has been employed heretofore is one in which a hot blank which is accommodated in a blank accommodating container (hereinafter referred to simply as the container) is placed under great pressure by a pressure or force generating apparatus, and the blank is caused to pass through a die provided at the extrusion end of the container opposite the end provided with the pressurizing apparatus whereby the forming of the blank is carried out.

In this process, there is a feature that a large cross section reduction ratio can be achieved for the blank in one pass and also it can be given an extremely complicated cross sectional shape. However, the forming load is extremely great as compared with the other metal forming processes such as rolling process, and moreover there are problems involved in the life of the die and the lubricant, and moreover continuous mass production such as in a conventional rolling process is difficult to perform and efficiency is low.

In a conventional extrusion apparatus, the die is fixed to the container, and accordingly, in order to shape the metal blank by causing it to pass the opening portion of the die which is shaped to produce a particularly large cross sectional reduction ratio, an extremely large extruding force is required which is impossible from the standpoint of installation. Also the metal blank is tightly pressed into the container under high pressure, so that lubrication of the inner wall of the container and the die cannot be carried out, and as a result, wear and tear are caused on the container and die, and consequently repair or replacement has to be made frequently. Moreover, if the extrusion is carried out with a reduction, a slower extrusion speed is inevitable, which factors are drawbacks which greatly reduce the productivity.

Lately, in order to overcome the foregoing drawbacks, a process of extruding metal wherein the metal is cooled at the outlet side of the extrusion opening and the forming is carried out while applying drawing power which is more than 30% of the yield stress of the extruded metal has been invented. In that invention, two systems are included wherein for generating drawing power, a drawing apparatus is provided, and for further generating drawing power work rolls are driven instead of providing a die with rotary work rolls. However, in these systems, in the latter system, there is a defect due to the generation of overfill and a problem of generation of overfill scar on the portion not contacting the die formed by the work rolls. This overfill spoils the appearance of the product and not only lowers the value of the product and but also makes the product almost unsuitable for the market.

Also, when a blank is used as a semi-finished product the corner portion of which is a right angle and no rounding of the corner portion is provided, and rolling is repeatedly carried out on this semi-finished product to produce a product, there are cases where scars are generated on the product by the rolling operation which takes place after the repeated rollings. Accordingly, in order to prevent the generation of scars due to the rolling operations, it is desirable that the corner portion be chamfered to a certain degree or be rounded.

SUMMARY OF THE INVENTION

An object of the present invention is to provide a metal extrusion process with high reduction which eliminates the foregoing problems in the conventional process, which is free from generation of defects such as overfill and also is capable of improving the productivity yet which operates of a low load and high reduction rate.

Further, another object of the present invention is to provide a metal extrusion process with high reduction which is capable of producing the desired shape of the desired corner portion with extreme ease and high precision.

In order to achieve the foregoing objects, the high reduction extrusion process according to the present invention comprises extruding a metal blank from a container through a forming pass formed by a plurality of driven work rolls, and guiding the metal blank to the pass from the outlet of the container by means of a forming die so that the metal blank is adapted to the shape of the pass, thereby preventing overfill of the metal blank in the forming pass.

BRIEF DESCRIPTION OF THE DRAWINGS

FIGS. 9*a*–9*e* are perspective views of blanks being extruded and FIGS. 9*f*–9*j* are graphs showing the overfill range;

in FIG. 12*a;*

DESCRIPTION OF THE PREFERRED EMBODIMENTS

Figure 1:
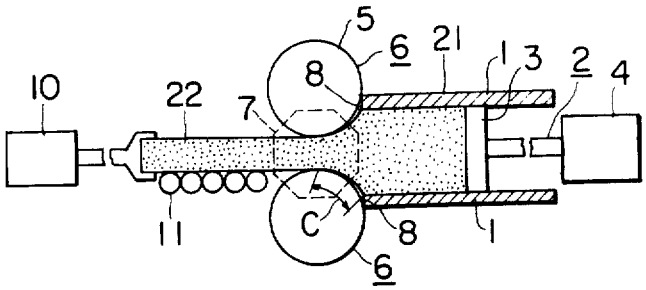
FIG. 1 is a schematic drawing showing the basic structure of an apparatus for carrying out the method of the present invention.

FIG. 1 is a schematic drawing showing the basic structural elements of the present invention. Reference numeral 1 denotes a container of box shape both ends of which are open, and numeral 2 denotes a pressure or force generating apparatus consisting of a pusher head 3 and a pusher head drive mechanism 4. Numeral 6 denotes a pair of horizontal rolls, and 7 denotes a pair of vertical rolls which contact the ends of both upper and lower horizontal rolls tightly so as to form a rotary die 5, and the horizontal and vertical rolls are positioned to form a die opening (for example, 14 in FIG. 3) in a single plane.

Also, the horizontal and vertical rolls 6 and 7 (i.e. the work rolls) are connected to a drive apparatus (not shown) by means of rotary shafts and a drive force transmitting mechanism (not shown), and can be rotated forcibly, and by disconnecting the connecting device connecting the rolls to the shafts to the power transmitting mechanism, such as a coupling, free rotation can be effected. At least one of the work rolls should be driven.

Furthermore, the tip of the container 1 is in contact with the rotary die 5. Also, back-up rolls may be provided in contact with each horizontal and vertical roll 6 and 7 forming the rotary die 5. Numeral 8 denotes a forming die which is positioned between the work rolls 6 and 7 on the outside of the container 1, and prevents the metal of a workpiece 21 from producing overfill of the blank at the gap between the tip of the container and the rotary die 5 during the extrusion.

Numeral 21 denotes a metal workpiece in the container 1, and 22 denotes a formed portion of the metal workpiece disposed on a roller table 11 for transfer of the metal workpiece which has passed through the rotary die 5.

When performing high reduction metal extrusion by employing an apparatus having the foregoing construction, the following steps are taken.

In the first place, the metal workpiece 21 which has been heated to an extrusion temperature is inserted into the container 1, and is urged continuously towards the rotary die 5 by means of a pressure generating apparatus 2. The magnitude of the pushing force at this time must be sufficient to cause the workpiece 21 to be extruded through and fill the die opening portion 14 (refer to FIG. 3) and which easily causes plastic deformation. To meet these requirements, the magnitude of the pushing force must be such that the compressive stress generated in the blank 21 by the pushing force, namely, the extruding stress is above 1.0 times the yield stress of the material of the workpiece 21 at the extrusion temperature.

Also, the extruding of the workpiece 21 through the rotary die 5 is continuously carried out not only when the workpiece 21 is first engaged with the work rolls 6 and 7 but also until the workpiece 21 passes through the die opening 14 of the rotary die 5. The extruding of the workpiece 21 can be carried out properly by a pressure or force producing apparatus consisting of a hydraulic cylinder, or a rack and pinion and motor engaged with the end of the workpiece 21 as shown in FIG. 1, but the present invention is not limited to these apparatuses.

Although the pushing force is applied to the workpiece 21 Since the magnitude of the pushing force generates a stress in the workpiece 21 of a magnitude workpiece 21 is long relative to its transverse dimension, such as a billet or a slab, the workpiece 21 tends to buckle due to bulging toward the side between the pressure producing apparatus 2 and rotary die 5. Accordingly, in order to prevent the buckling, the container 1 is used.

Although it is desirable that the container 1 be constructed integrally in a box shape from the standpoint of its operation, in order to reduce the friction force between the container 1 and the workpiece 21, a part of the container 1 may be replaced with a plurality of sets of pinch rolls with upper and lower rollers and right and left rollers being respectively opposed, or a caterpillar apparatus wherein upper and lower parts and right and left rollers are provided respectively may be employed as the container.

The container 1 is disposed so that the tip portions contact the cylindrical peripheral portions of the rolls 6 and 7 of the rotary die 5, but between the tip portion and the rotary die 5, namely, outwardly of the corners of the die opening 14 gaps exist between the tip portion of the container 1 and the end portions of adjacent work rolls 6 and 7. A part of the workpiece 21 forced from the container 1 enters the gaps between the end portions of the work rolls 6 and 7 instead of being extruded through the die opening, thereby generating so called overfill. In this invention, in order to prevent the overfill, the workpiece 21 entering the gap is guided by the forming die 8 which has portions covering the gaps.

Figure 2:
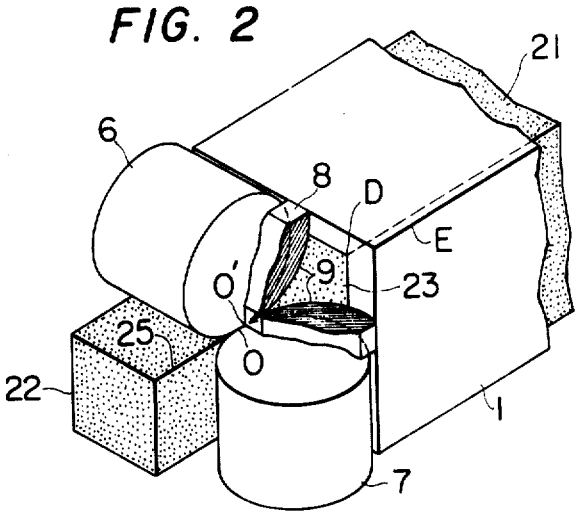
FIG. 2 is a perspective view of a forming die employed in the present invention and part of which is broken away.

FIG. 2 shows one example of the forming die, and in order to facilitate an understanding of the structure of the forming die 8, the work rolls 6 and 7 are as being right circular cylindrical in shape, and their end peripheral edges are positioned so as to be in initial contact at point 0. As shown in FIG. 2, the forming die 8 has a smooth guiding surface 9 covering each of the four gaps around the rotary disc 5 and curving from the end of the container 1 toward the contact point 8 between adjacent rolls, which point 0 is at the corner 25 of the rolled workpiece 22 which has a cross-sectional shape with sharply angled corners. Accordingly, the portion 23 of the workpiece which is located between the end of the container 1 and the die opening 14 has the cross-section thereof reduced gradually as it is extruded into the opening 14 so as to adapt gradually to the narrowest portion of the space within the rotary die 5 (namely, the die opening 14 that corresponds to the cross-section of the rolled workpiece 22). The guiding of the workpiece 21 is started simultaneously with the entering of the workpiece 21 into the rotary die 5 but at the corner portion of the workpiece it is started at point D, i.e. the corner of the container 1, and it may be started from a position within the container 1, for example, from point E. The terminal point 0' of the guiding of the workpiece by forming die 8 is preferably as close as possible to the contact 0 point of the work rolls 6 and 7, but as shown in FIG. 2, it may be nearer the container side instead of right at the contact point 0. If the terminal point 0' does not coincide with the contact point 0, 0' is not a point but a curve. Also, the forming die 8 can be integral with the container 1.

Figure 3:
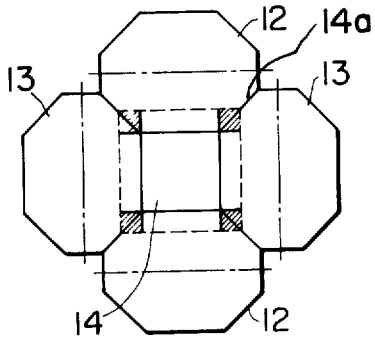
FIG. 3 is an end elevation showing one example of work rolls for forming a product having a square cross section.

In FIG. 2, the work rolls 6 and 7 are right circular cylindrical in shape, but in practice the work rolls, in order to facilitate easy positioning of rolls and to minimize the size of the gap and to prevent overfill, the work rolls have end portions of circular truncated conical shape as shown in FIG. 3, and the end portions of the adjacent work rolls 12 and 13 mutually contact each other along lines 14*a*.

Figure 4:
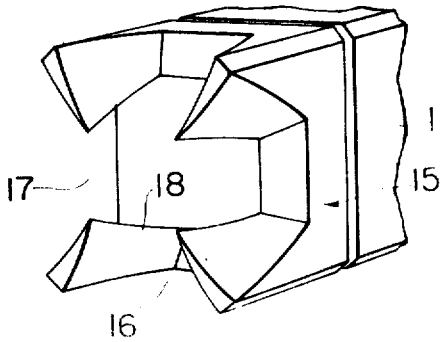
FIG. 4 is a perspective view showing one example of a forming die employed with the work rolls of FIG. 3.

One example of the forming die in which the work rolls 12 and 13 of FIG. 3 are emloyed for guiding the blank from the point D, i.e. the end of container 1, is shown in FIG. 4. Forming die 15 is fixed to the end of the container 1, and the work rolls 12 shown in FIG. 3 are disposed in the spaces 16 and the work rolls 13 are disposed in the spaces 17. The corner portion of the workpiece 21 is guided by the surface 18. The shape of the workpiece which is at the middle of the rolling process in the extruding apparatus provided with this forming die 15 is shown in the perspective view and in front in FIGS. 5*a* and 5*b*.

As described in the foregoing, the workpiece 21 which is extruded through the die opening 14 of the rotary die 5 is formed while rotatably driving the work rolls 6 and 7 or at least some of the rolls. At this time, the work rolls are forcedly rotated so that the maximum value of the peripheral speed of the work rolls is above the minimum surface speed of the workpiece in the peripheral direction of the work rolls in the contact arc *c* (FIG. 1) between the work rolls and the workpiece. This means that at least in one part of the contact arc, the peripheral speed of the roll is faster than the surface speed of the workpiece, and also includes the case where in all the portions in the contact arc, the peripheral speed of the roll is faster than the surface speed of the workpiece. In all the portions of the contact arc, if the roll peripheral speed is less than the surface speed of the workpiece, the roll drive power is not transmitted to the workpiece, and the reduction effect of the extruding force cannot be achieved.

The faster the peripheral speed of the work rolls, the smaller the pushing force applied to the workpiece 21 becomes.

Figure 6:
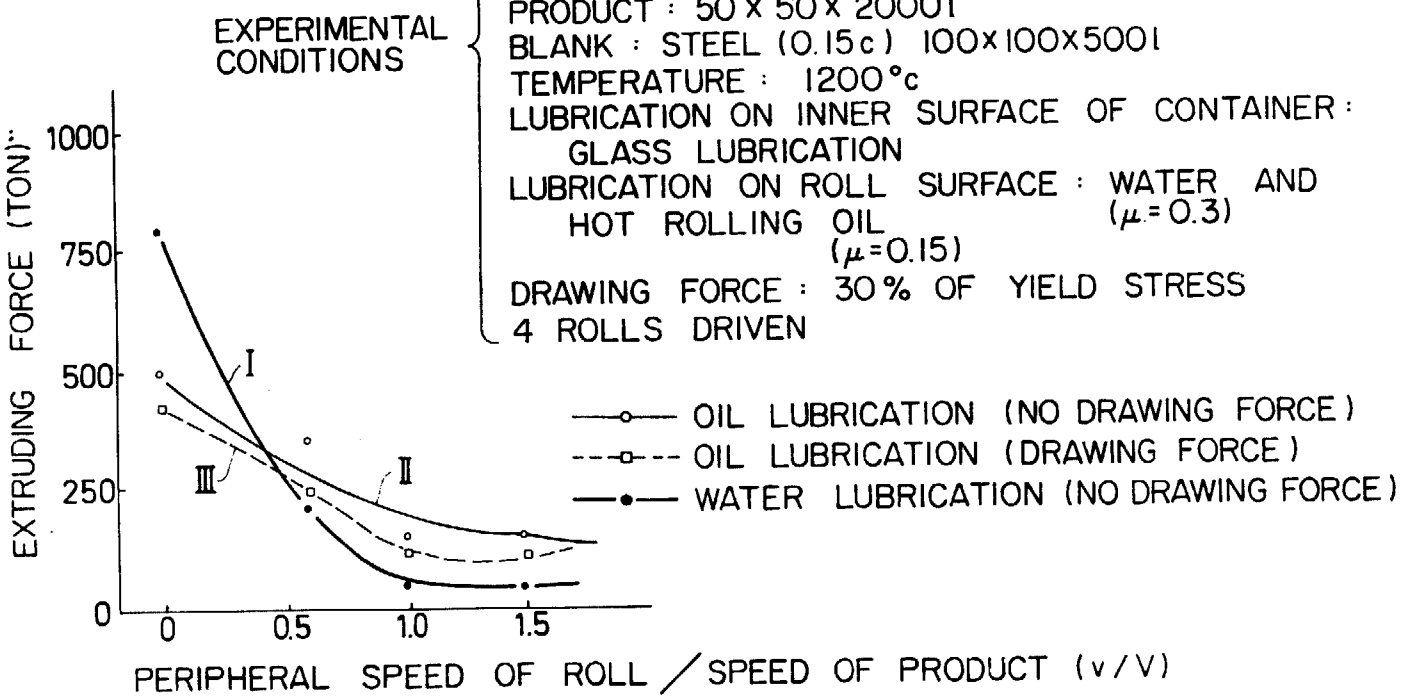
FIG. 6 is a graph showing the relationship between the peripheral speed of work rolls and the extruding force.

FIG. 6 is a graph showing the relationship between the ratio of the peripheral speed of the work rolls and the speed of the workpiece at the outlet of the rotary die 5 (speed of the rolled workpiece 22) and the extruding force. According to this graph, it will be understood that when the peripheral speed of the work rolls is increased, the extruding force is be greatly decreased.

Furthermore, it is possible to obtain a good cross sectional shape of a product by increasing the peripheral speed of the work rolls. For example, if the cross sectional shape of the product is square, it is perferable that the corner portion of the product be slightly chamfered for improved handling of the product. On the other hand, in the present invention, by increasing the peripheral speed of the work rolls, it is feasible to form the corner portion into the chamfered shape or rounded shape.

When the pushing force and the shape of the corner portion are taken into consideration, it is preferable in the present embodiment to set the peripheral speed of the work rolls above 0.5 times of the speed of the workpiece at the outlet.

In the present embodiment, the rotary die 5 is formed by two sets of cylindrical rotary bodies having a pair of parallel opposed axes, but the rotary die 5 need not be limited to this particular shape, and within the scope of the present invention, it can be formed by one set or more than three sets of cylindrical rotary body pairs.

Also, as shown in FIG. 1, by applying a tensile stress of at least more than 0.01 times the yield stress of the workpiece and less than 1.0 times thereof to the rolled portion 22 of the workpiece by means of a drawing apparatus provided at the extruding side, the forming operation can be easily performed at a low load and a high reduction rate. The reason for making the tensile stress less than the yield stress as described above is that the rolled workpiece 22 is prevented from being broken. Also, if the tensile stress is less than 0.01 times the yield stress, the foregoing effect of the application of the drawing force cannot be obtained. The graph of FIG. 6 shows one example of the effect when the tensile force is applied. When using a lubricant, the magnitude of the extruding force when the tensile force is applied is smaller than 10 – 30% as compared with the case where the tensile force is not applied. Also, when the tensile force is applied, as the roll load is reduced, the wear and tear on the work rolls is greatly reduced, and an increase of the useful life of the rolls can be achieved.

As described in the foregoing, this invention is constructed in such a way that the metal workpiece accommodated in the container is extruded by the force producing apparatus while guiding the workpiece by means of the forming die, and the workpiece is caused to pass the rotary die formed by a plurality of work rolls provided at the end portion of the container, and if need be a tensile force is applied to the workpiece at the outlet side of the work rolls. Accordingly, this invention is capable of the effects as described in the following.

(1) For a given workpiece and the same cross-section reduction rate, the extruding load can be greatly reduced by the present invention.

(2) A decrease of the extruding force can be achieved by causing the peripheral speed of the rotary die to be faster than the speed of the workpiece.

(3) A product having an excellent cross section can be obtained without generating overfill.

(4) Furthermore, the lubrication of the portion corresponding to the stationary die in the conventional extrusion apparatus becomes possible, improvement of the life of the die going in hand with the small forming load. When a drawing force is added, the life of the die will be improved.

In the extrusion process as described above, when there is a gap between the work rolls and the forming die, depending on the rolling conditions, overfill is generated. If the overfill can be ignored because it does not produce a problem or it is such that can be easily removed by grinder, there will be no problem. However, as described in the foregoing, because of deterioration of the value of product if the edges are damaged, occurrence of scraps if the overfill is too excessive and generation of scars during rolling, it is preferable to provide a radius of curvature or chamfer of a certain size on the corner portions of the product. To provide the corner radius of curvature on the product is well worth doing in practice, but when the present inventors reviewed the matter in detail in the extrusion process described above, and although it has been discussed briefly in the foregoing, the present inventors discovered a technique of freely controlling the corner radius of curvature. The method of controlling the shape of the corner portion of the product will be described in detail in the following.

Figure 7:
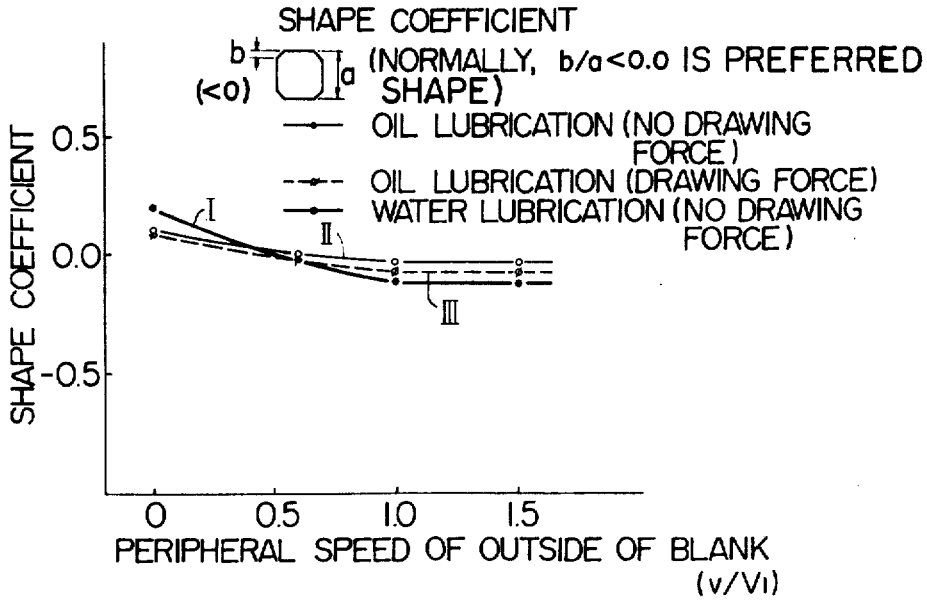
FIG. 7 is a graph showing the relationship between the peripheral speed of the work rolls and the cross-sectional shape of the product.
Figure 8A:
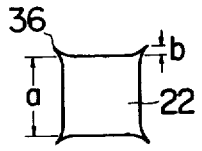
FIGS. 8*a*–8*f* are cross-sections of a product showing examples of the shape of the corner portions.

As described in the foregoing, the shape of the corner portion of the extruded and formed product is related to the peripheral speed of the work rolls 6 and 7. FIG. 7 is a graph showing relationship between the peripheral speed of the work rolls and the shape of corner portion when a product having a square cross section is rolled. In the graph, the peripheral speed of the work rolls is represented by the ratio of that speed to the outlet speed of the workpiece, and the shape of the corner portion is represented by a coefficient. The shape coefficient is defined by the ratio of the length a of a side of the product and the height b of the chamfer (refer to FIG. 8*c*). The height b of the chamfer (or underfill at the corner) is indicated by a minus value, and as shown in FIG. 8*a*, the height of the overfill 36 is indicated by a plus value of *b*. Curves I, II and III in FIG. 7 correspond respectively to curves I, II, III in FIG. 6, and the working conditions are identical.

Figure 8B:
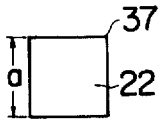
Figure 8C:
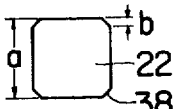
Figure 8D:
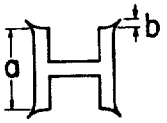
Figure 8E:
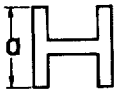
Figure 8F:
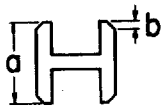

As will be obvious from FIG. 7, when the peripheral speed of the work rolls becomes faster, the shape coefficient becomes gradually smaller. For example, in the curve I, when the ratio of the peripheral speed of the work rolls to the outlet speed of the workpiece is 0.3, overfill is generated as shown in FIG. 8*a*, and when the ratio is 0.5, a sharp edge 37 is generated as shown in FIG. 8*b*. Also, when the ratio of the peripheral speed of the work rolls to the outlet speed of the workpiece becomes 1.0, chamfer 38 is generated on the corner portion as shown in FIG. 8*c*. This phenomenon occurs even where general shapes other than billets having a square cross section are rolled. One example with respect to H-shapes is shown in FIGS. 8*d*, 8*e*, 8*f*.

This invention obtains the required shape by utilizing the relationship between the peripheral speed of the work rolls and the shape of the corner portion and adjusting the peripheral speed of the work rolls, but the cause for generation of the underfill at the corner will be described in detail in the following.

Figure 5A:
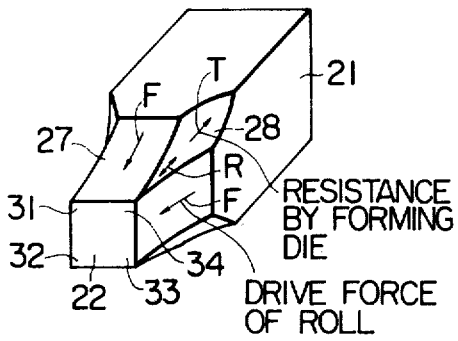
FIG. 5*a* is a perspective view of a metal blank being extruded.
Figure 5B:
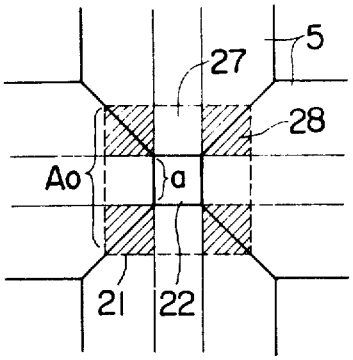
FIG. 5*b* is a schematic transverse section of the rolls and the blank.

First, refer to FIGS. 5*a* and 5*b*. FIG. 5*b* is a transverse cross section of the workpiece immediately after the rolls in the direction of movement of the workpiece. The surface 27 and surface 28 in FIG. 5*a* correspond respectively to surface 27 and surface 28 in FIG. 5*b* and these surfaces represent surfaces on the workpiece being extruded by the work rolls and forming die respectively.

If there is no gap between the work rolls and the forming die, the corner portions 31, 32, 33 and 34 of the product will be at right angles as shown in FIG. 5*a*. However, actually, as shown in FIG. 7 and FIG. 8*a*, where the ratio of the peripheral speed of roll is small, overfill is generated, and this indicates that there is a gap between the work rolls and the forming die. On the other hand, where the ratio of the peripheral speed of the rolls is large underfill is generated at the corner. The presence of the underfill at the corner indicates generation of reduced width in the diagonal direction of the ingot during the rolling, and therefore a tensile force R must be working on the surface 28 as shown in FIG. 5*a*. This tensile force R is generated by the drive force F caused by the rolls and resistance force T caused by the forming die.

Next, the relationship between the length of underfill at the corner (namely, the magnitude of tensile force R) and the ratio of the peripheral speed of rolls (i.e. $v/V$, where $v$: roll peripheral speed, V: speed of product) will be described in the following. The force working on the workpiece during rolling with respect to each ration $v/V$ of the peripheral speed of the roll is illustrated in FIGS. 9*a*–9*e*, wherein:

P: pushing force

T: resistance force of the forming die $F_1$: roll driving force $F_2$: resistance force of the roll surface In the drawing, thick line N—N is the position where the peripheral speed of the roll is compatible with the surface speed of the workpiece, and it is a collection of neutral points, and shall be called a neutral line.

N—N is generally a curve but for simplicity of explanation, it is indicated as a straight line. The friction force of the portion of the workpiece surface contacting the surface of the inside of the container has to substantially nothing to do with this matter and therefore, it is omitted in this explanation.

First, with $v/V = 0$, and the rolls being fixed is considered. In this case, the roll drive force $F_1 = 0$, and accordingly, the tensile force $R \leqq 0$, and the blank has a tendency to bulge outwardly as the surface is reduced, and if there is a gap, the workpiece generates overfill. The force for generating the overfill resulting from the reduced surface is called the overfill force.

When the rolls are driven and $0 < v/V < 1.0$, a neutral line exists at M—M and L—L.

In this case, P and $F_1$ are forces for advancing the workpiece forward, and $F_2$ and T are forces for preventing the advancement. Also, on the corner portion shown in the drawing, the tensile force R based on $F_1$ and T is generated.

In the region where the tensile force R is working, a reduction of width occurs, but when this region is passed, the tensile force no longer exists and a tendency for expansion of width (overfill) occurs and when the surface of the workpiece comes into contact with the surface of the forming die due to the expansion of width, overfill occurs if there is a gap between the work rolls and the forming die.

This relationship is illustrated in FIGS. 9*f*–9*j*. As will be obvious from this drawing, the greater the width reduction region G indicated by oblique lines, the stronger the action of holding the overfill in the width expansion region H becomes, thereby preventing the overfill.

In short, the neutral line shifts towards the outlet of the rotary die as $v/V$ becomes larger, and as a result, the width reduction region in which the tensile force R is working becomes wider and consequently the underfill at the corner portion occurs.

The underfill phenomenon at the corner as described in the foregoing is an important discovery which has not been found in any type of conventional rolling, and on account of this phenomenon, a product with an elongation of more than 15 times the initial length of the workpiece with corners with a proper radius of curvature can be manufactured as will be described with reference to FIG. 10.

Next, the underfill behavior at the corner when the elongation is varied will be described in the following. FIG. 10 shows an embodiment wherein the elongation is changed in a variety of ways.

For each case of the elongation λ, i.e. for values of 4.0, 7.1, and 15.6, the relationship of the shape coefficient $b/a$ representing the underfill at the corner and the ratio of peripheral speed of rolls $v/V$ has the same inclination. Where the conditions of shape coefficient 0 and overfill 0, $v/V$ is set at $(v/V)^*$ and when $b/a$ no longer depends on v/V, v/V reaches $(v/V)^{}$ and $b/a$ becomes $(b/a)^{}$.

A description of $(b/a)^{**}$ will be given before the relation between $(v/V)^*$ and $(v/V)^{**}$ is described.

Figure 11A:
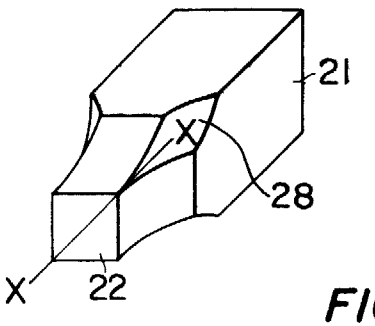
FIG. 11*a* is a perspective view of the metal blank been extruded and FIG. 11*b* is a cross section along line X—X of FIG. 11*a;*
Figure 11B:
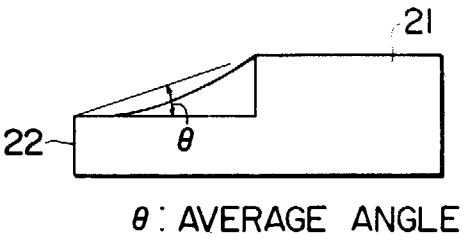

The part of the roll drive force $F_1$ in the parts of FIG. 9 is generated to overcome the resistance force T of the forming die. Therefore, the tensile force R becomes larger as the resistance force T becomes bigger. Accordingly, the magnitude of the resistance force T is obtained. T is proportional to the following formula $\sigma t/k$ used in drawing operations.

$$\frac{\sigma_t}{k} = (1+\frac{\mu}{\theta})\ln(\frac{A}{a})^2 + \frac{2}{3}\theta \quad (1)$$

where $t$: drawing stress $k$: average flow stress $\mu$: friction coefficient $\theta$: average angle of FIG. 11*b*

On the other hand, T may be assumed to be proportional approximately to the cross-section along line X—X in FIG. 11*a* through the surface 28. When the cross section through the surface 28 is divided by the cross section of the workpiece, a dimensionless quantity, $\frac{1}{4}(1-a/Ao)^2$ is obtained.

Accordingly, T is expressed by the following formula.

$$T = c(1-\frac{a}{Ao})^2\{(1+\frac{\mu}{\theta})\ln(\frac{Ao}{a})^2 + \frac{2}{3}\theta\} \quad (2)$$

where c is constant. $(b/a)^{**}$ depends on T as represented for the formula (2) by the foregoing reason.

Figure 10:
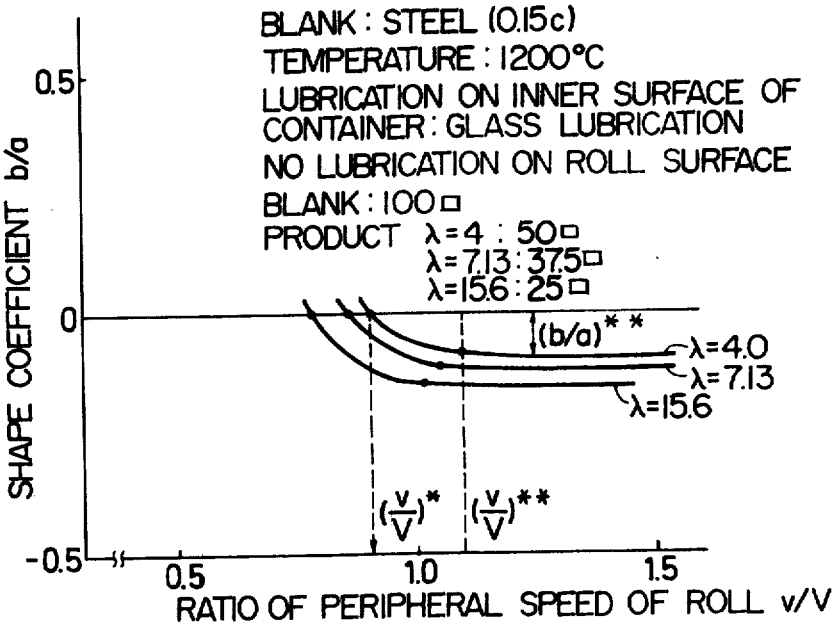
FIG. 10 is a graph showing the relationship between the peripheral speed of the rolls and the shape coefficient, and particularly showing the roll peripheral speed ratio wherein underfill at the corner occurs and also the roll peripheral speed ratio wherein the underfill length at the corner no longer depends on the peripheral speed of the rolls even if the peripheral speed of the rolls is increased.
Figure 9G:
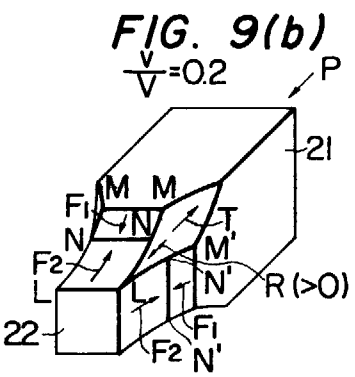
Figure 9G:
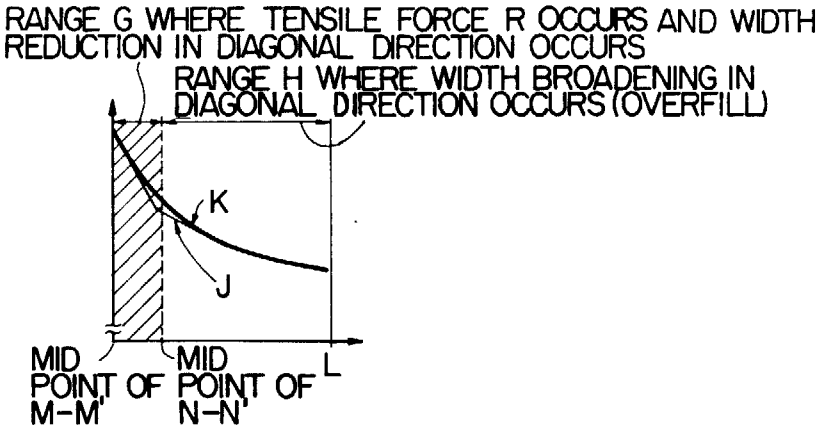
Figure 9F:
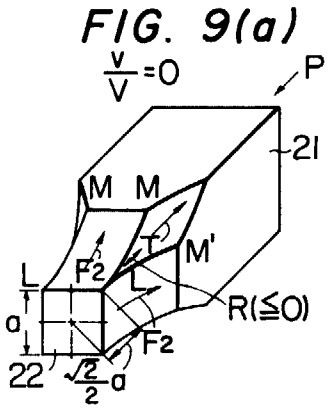
Figure 9F:
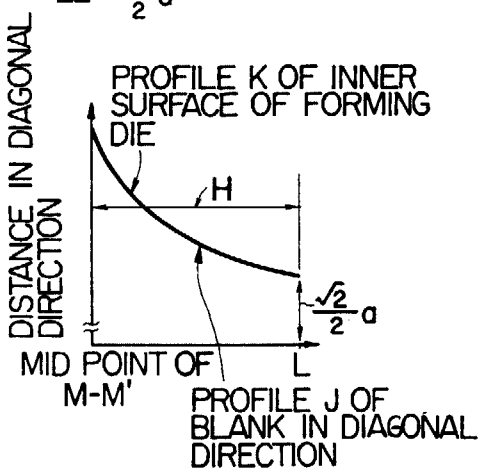
Figures 9C, 9D, 9E, 9H, 9I, 9J:
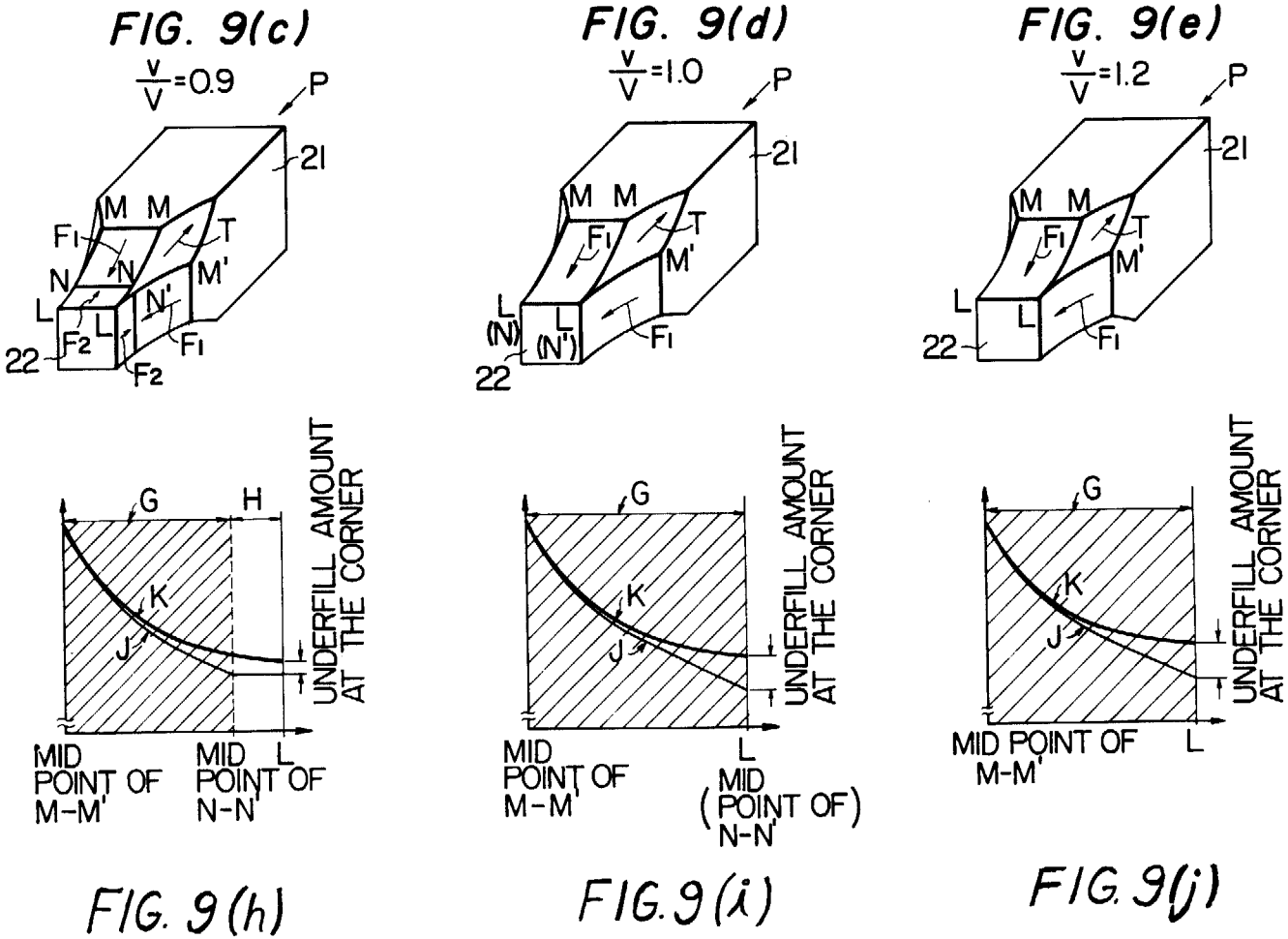

As will be obvious from FIG. 10, $(b/a)^{**}$ becomes larger as the elongation λ becomes greater, because according to the formula (2), as the elongation λ (= $(A/a)^2$) becomes greater, the resistance force T becomes larger.

Next, the curve between $(v/V)^*$ and $(v/V)^{**}$ will be described.

This curve is approximately a hyperbola and is represented by the following experimentally derived formula:

$$\frac{b}{a} = -A + \frac{B}{\frac{v}{V}+C} \quad (3)$$

where A, B, C are constants obtained from experiments, and having the following meaning.

A: depends on $(b/a)^{**}$, namely, the larger the resistance force T of the forming die, the smaller is A (absolute value is large). Normally, it has a value in the range of −0.5 - 5.0.

B: depends on the rate of change of tensile force R arising from the transfer of the neutral line and is a constant. Normally, it has a value in the range of 0 - 5.0.

C: constant depending on resistance force T. Normally, it has a value in the range of 0 - 5.0.

Figure 12A:
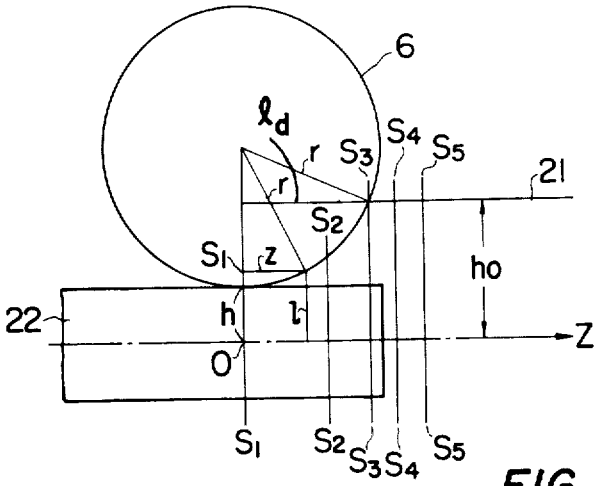
FIG. 12*a* is a diagram for explaining the shape of the longitudinal cross section of the metal blank during forming.
Figure 12D:
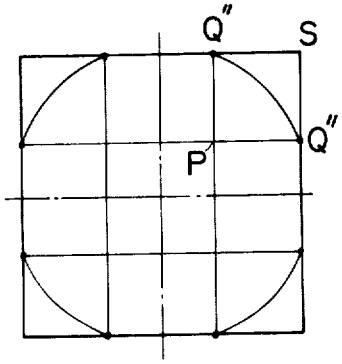
FIGS. 12*b*–12*f* are diagrams showing the cross-sections at lines $S_1 — S_1$, $S_2 — S_2$, . . .
Figure 12C:
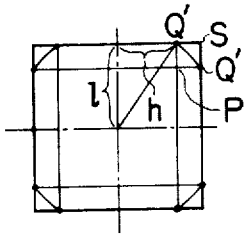
Figure 12B:
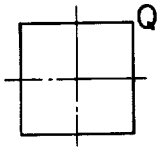
Figure 12E:
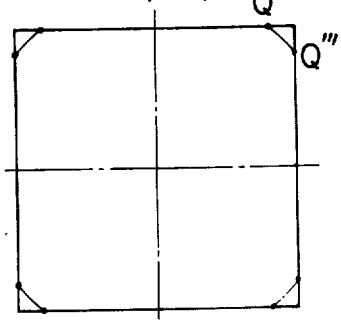
Figure 12F:
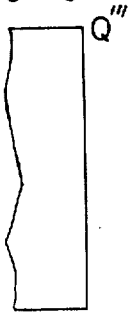

Next, the restricting condition of the forming die will be described. A case in which there is rolled a workpiece having as initial thickness $Ao = 2h_o$, a finished product thickness $a = 2h$, by rolls having roll diameter $= 2r$ as shown in FIG. 12*a* will be considered. Transverse cross-sections $S_1$—$S_1$ to $S_5$—$S_5$ of the workpiece of FIG. 12*a* are shown in FIGS. 12*b*–12*f*, the sections being taken at different distances from a transverse plane through the roll centers. It will be understood from this drawing that the inner surface of the forming die should meet the surface of the work rolls at Q, Q', Q''. This portion of inner surface of the forming die is required to be a curved surface bounded by the points Q-Q'-Q''-Q''-Q'-Q. However, Q is not necessarily exactly at the roll as will be obvious from the description of FIG. 2, and it may be located at a position closer to the incoming workpiece. The entire curved surface of the die bounded by points Q-Q'-Q''-Q'''-Q''''-Q'''-Q''-Q'-Q. Point Q'''' corresponds to the corner of the workpiece at which shaping is started by the inner surface of the die. This point Q'''' has to be spaced from the die opening in the direcion from which the workpiece is entering the pass a distance greater than the length $l_d$ of the arc of contact of the roll and the workpiece, i.e. beyond the position of cross-section $S_3$—$S_3$. When the die opening, i.e. the cross-section $S_1$—$S_1$ is taken as the origin, and the Z-coordinate is toward the position from which the workpiece is being fed, the position of coordinate Z'''' for point Q'''' must satisfy the condition of the following formula;

$$Z'''' \geqq ld \quad (4)$$

Q'''' is the point where the inner surface of the container starts decrease in cross-section, and it is the forward limit of the movement of the pusher head. Accordingly, it is not desirable from practical standpoint to have Q'''' too far in the direction of coordinate Z.

From a practical standpoint:

$$ld + 2\,ho \geqq Z'''' \geqq ld \quad (5)$$

Therefore the coordinates should be in the range indicated above.

Next, in the range of formula (5), there will be an optimum value of Z'''' determined as follows. The average angle $\theta$ of FIG. 11*b* can be represented by the following formula for the values of FIGS. 12*a*–12*f*:

$$\Theta = \tan^{-1}\frac{\sqrt{2}\,ho - \sqrt{2}\,h}{Z''''} \quad (6)$$

When $Z'''' = ld$, $\theta$ is $\theta o^*$. When $Z'''' = ld + 2h_o$, $\theta$ is $\theta_1^*$.

Figure 13A:
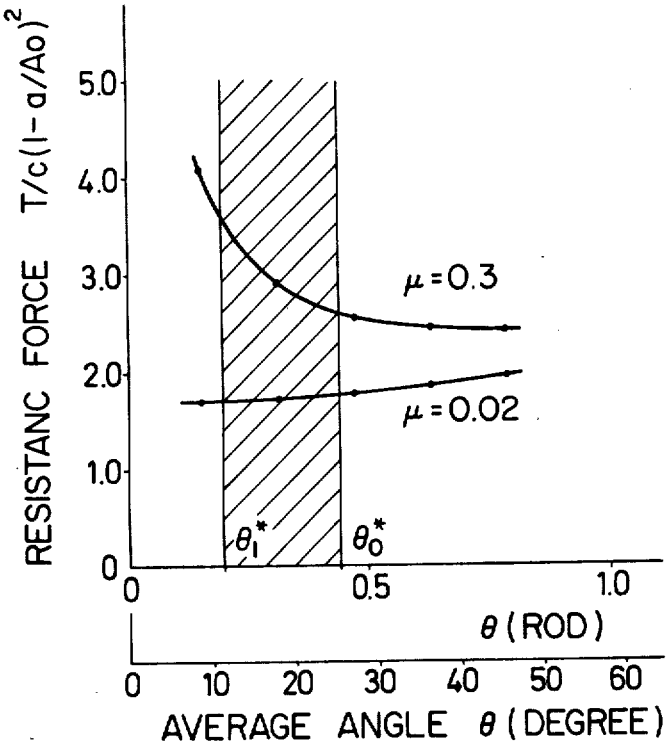
FIG. 13*a* is a graph showing the relationship between average angle $\theta$ and resistance force T and FIGS. 13*b* and 13*c* are respectively perspective views showing the shape of the workpiece lower limit angle $\theta$*l and upper limit angle $\theta$*o.
Figure 13B:
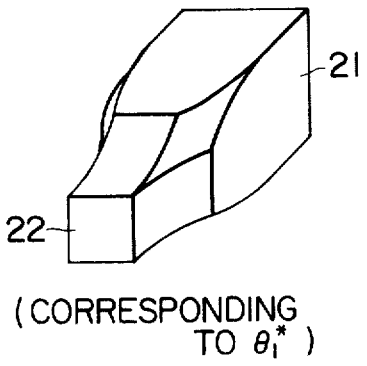
Figure 13C:
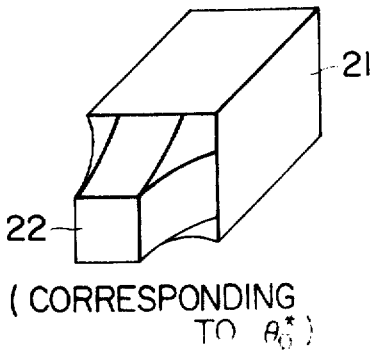

The resistance force T of the forming die is obtained from the formula (2) for $\mu = 0.3$ and 0.2 and for a roll diameter $2r = 250$, a thickness of the incoming workpiece $Ao = 2ho = 100$, thickness of the finished workpiece $a = 2h = 50$, and the resistance force is indicated in FIG. 13*a*. The actually used average angle of the forming die is in the range of the oblique line of FIG. 13*a* since $\theta o^*$ is considered to be the upper limit and similarly $\theta_1^*$ is the lower limit. From this drawing, it will be understood that when the friction coefficient $\mu$ is large, such as where there is no lubrication, it is better to use the forming die of the type shown in FIG. 13*c* which has an angle closer to $\theta o$ because the underfill length $(b/a)^{}$ becomes large due to a high resistance force and where the friction coefficient $\mu$ is closer to 0, it is better to use a forming die of the type shown in FIG. 13***b* which has an angle closer to $\theta_1^*$ for the same reason.

Figure 14:
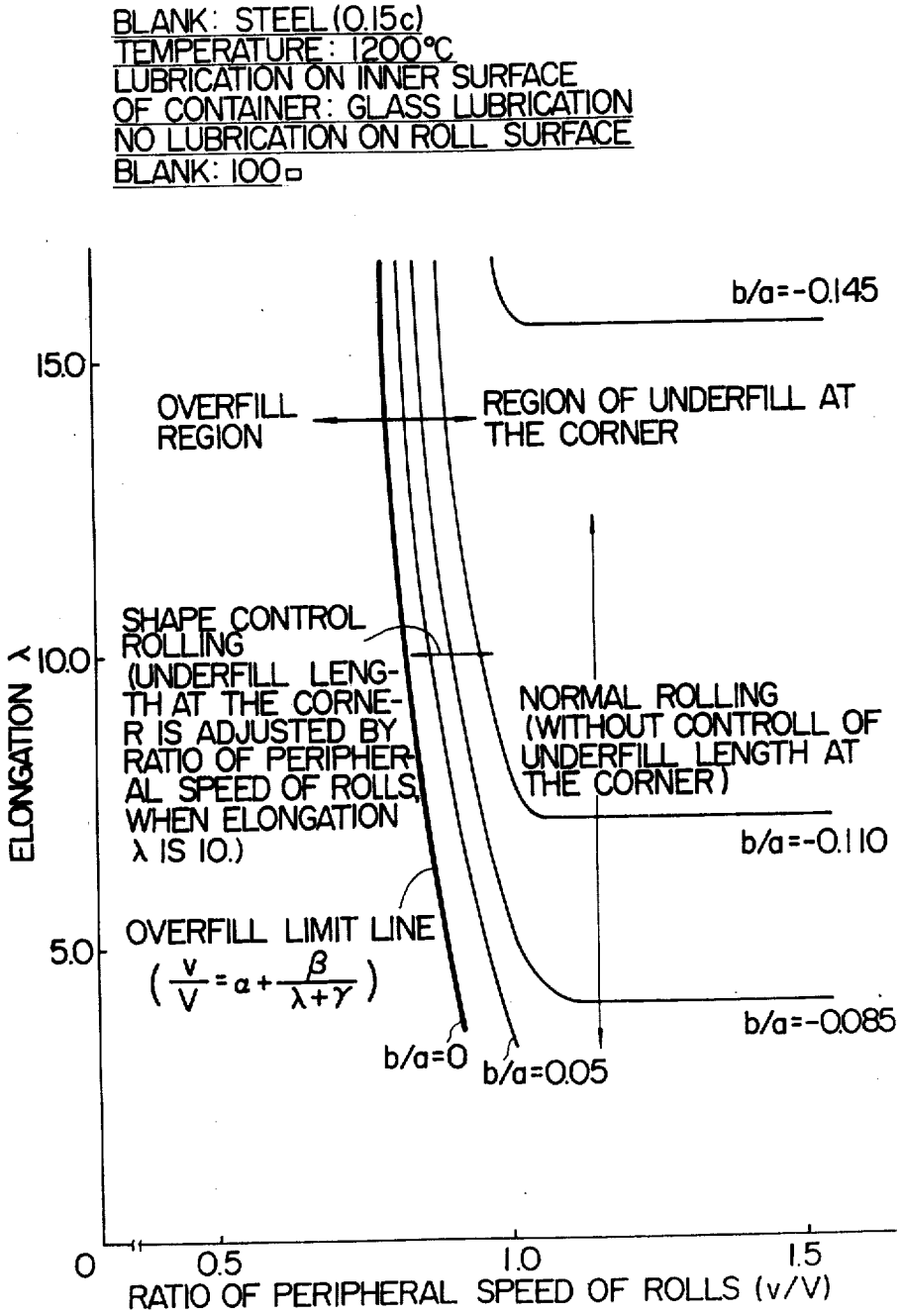
FIG. 14 is a graph showing the relationship between the peripheral speed ratio of the rolls and elongation, and showing the overfill limit line.

FIG. 14 is a graph showing the relationship between the ratio of peripheral speed of roll $v/V$ and elongation $\lambda$, and showing the overfill limit line. The ratio of peripheral speeds $v/V$ at the time when the underfill at the corner starts is generally a function of the elongation $\lambda$, lubricating condition, and the ratio of the roll diameter/blank side length, and is represented by the following formula (7).

$$\left(\frac{v}{V}\right)^* = \alpha + \frac{\beta}{\lambda + \gamma} \quad (7)$$

where $\alpha$, $\beta$ and $\gamma$ are constants dependent on the rolling operation conditions, namely, the lubricating condition and the ratio of roll diameter/blank side length. Normally, a value in the following ranges can be used.

$0 < \alpha \leqq 1.5$ $0 \leqq \beta \leqq 10$ $0 \leqq \gamma \leqq 10$

In the example of FIG. 14, $\alpha = 0.72$, $\beta = 1.47$, $\gamma = 3.33$.

The method of controlling the corner shape will be described in the following on the basis of the foregoing discovery.

First of all, an experimentally determined formula with respect to shape coefficient is shown below.

$$\text{when } \left(\frac{v}{V}\right)^* \leqq \frac{v}{V} \leqq \left(\frac{v}{V}\right)^{**}, \text{ then } \frac{b}{a} = -A + \frac{B}{\frac{v}{V} + C}$$

$$\text{when } \left(\frac{v}{V}\right)^{} < \frac{v}{V}, \text{ then } \frac{b}{a} = \left(\frac{b}{a}\right)^{} \quad (8)$$

where $(v/V)^*$: value of $v/V$ when the underfill at the corner starts. $0.5 \leqq (v/V)^* \leqq 1.0$ Constant dependent on elongation, roll diameter, friction coefficient.

$(v/V)^{}$: value of $v/V$ when the underfill length at the corner starts not depending on $v/V$. $0.5 \leqq (v/V)^{} \leqq 1.4$ Constant dependent on elongation, roll diameter, friction coefficient.

$(b/a)^{}$: value of $b/a$ when $(v/V)^{}$, and constant dependent on elongation, roll diameter, friction coefficient. $-0.3 \leqq (b/a)^{} \leqq 0$ A: dependent on $(b/a)^{}$, and accordingly is a constant dependent on elongation, roll diameter and friction coefficient. $0 \leqq A \leqq 1.0$ B: dependent on the change rate of the tensile force R as indicated by transfer of neutral line, and accordingly, is constant dependent on elongation, roll diameter, and friction coefficient. $0 \leqq B \leqq 1.0$ C: dependent on resistance force T, and accordingly, is constant dependent on elongation, roll diameter, and friction coefficient. $-1.0 \leqq C \leqq 0$ As the examples of these constants, values of the case where elongation $\lambda = 4.0$, $\lambda = 15.6$ in FIG. 10 are shown in TABLE 1.

TABLE 1

| elongation | $(\frac{v}{V})^*$ | $(\frac{v}{V})^{**}$ | $(\frac{b}{a})^{**}$ | A | B | constant C |
|---|---|---|---|---|---|---|
| 4.0 | 0.910 | 1.100 | −0.080 | 0.306 | 0.164 | −0.374 |
| 15.6 | 0.790 | 1.025 | −0.145 | 0.201 | 0.0184 | −0.699 |

According to this invention, the relationship between the peripheral speed of work rolls and the shape of the corner portion as shown in FIG. 10 is utilized, and the peripheral speed of the work rolls is adjusted to obtain the required shape. In general, the shape of the corner portion is ordinarily controlled according to the request of the customer so that it becomes a proper value in the range of $-0.2 \leqq b/a \leqq 0$. In a square cross section, a value closer to $b/a \div -0.1$ is used, and shapes such as an H-shape or an inverted shape normally, a negative value which is closer to $b/a \div 0$ is obtained.

In the field of actual operation, the peripheral speed of the work rolls will be determined in the following manner. The peripheral speed of work rolls can be obtained by the formula (8) from the speed V of the of the workpiece on the outlet side of the roller die which is required for sucessive lines and the necessary corner shape. And, also, when a variation of the formula (8) is used, the following formula is used.

$$\text{with } \left(\frac{v}{V}\right)^* \leqq \frac{v}{V} \leqq \left(\frac{v}{V}\right)^{**}, \Delta v = -\frac{V}{B}\left(\frac{v}{V} + C\right)^2 \frac{\Delta b}{a} \quad (9)$$

$$\text{with } \left(\frac{v}{V}\right)^{**} < \frac{v}{V}, \Delta v = 0$$

This formula shows relationship between the amont of fluctuation $\Delta b$ of the underfill at the corner during the rolling and the amount of fluctuation $\Delta v$ of the peripheral speed of the work rolls.

Accordingly, the formula (9) can be used for the dynamic control of the underfill at the corner during the rolling. Namely, deviation $\Delta b$ from the target value of the underfill at the corner and speed V of finished workpiece at the output side of the rotary die are detected by means of a proper detecting means during the rolling, and the correction amount of fluctuation $\Delta v$ of the peripheral speed $v$ of the work rolls is obtained from the formula (9) and the feedback control is effected so that $\Delta b$ becomes 0.

In the present embodiment, the rotary die 3 is formed by two sets of work rolls with each set having a pair of spaced parallel axes, but the structure is not limited to this construction. It can be formed by one set or more than three sets in the range yet not depart from the object of the present invention. Moreover, objects to be rolled are not limited to billets or H-shapes but the method can be applied easily to plate rolling or rolling of general shapes (inverted shapes, sheet pile).

As will be obvious from the foregoing detailed description, according to the present invention, the shape of the corner portion of the product can be freely controlled so that it becomes a desired shape, and therefore a good appearance of the product can be obtained and with the omission of grinding work on the overfill, improvement of the work efficiency can be obtained. Furthermore, the control of the shape of corner portion can be achieved by merely adjusting the peripheral speed of the work rolls, and therefore it is extremely simple and convenient.

The following advantages are provided by the shape control process as described in the foregoing.

(1) The shape of product is extremely good. Namely, the radius of curvature of the corner can be controlled to a required value.

(2) Large elongation can be achieved.

On accoound of the large elongation which can be obtained, the present invention makes it possible not simply to replace a billet mill, but makes it possible in rolling wire material and shapes to replace the mill for rough rolling and intermediate rolling with a single mill, whereby large scale reduction in installation expenses and labor can be achieved.

Figure 15:
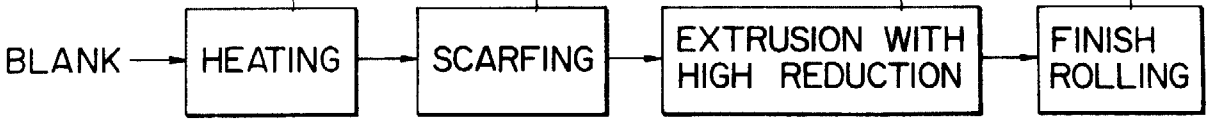
FIG. 15 and FIG. 16 are flow charts showing examples of the forming process metal blanks by high reduction extrusion according to the present invention.
Figure 16:
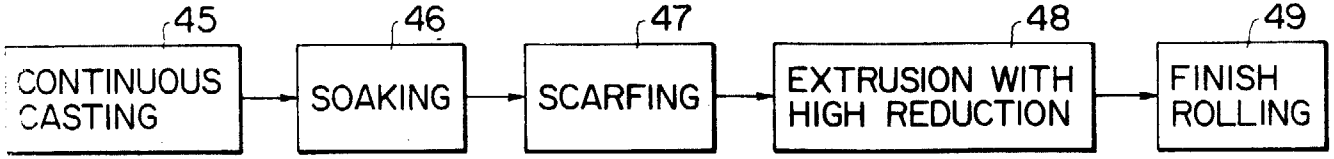

FIG. 15 and FIG. 16 show examples wherein the extrusion with high reduction according to the present invention is used in the manufacturing process for rolling shapes from billets. In the process of extrusion with high reduction, the blank is formed into the required cross section in one pass with large elongation, for example, to more than four times its original length by using one high reduction extruding machine.

In FIG. 15, the blank is heated to the working temperature at 41, and then the surface defects are removed by scarfing at 42. The blank is shaped by the high reduction extrusion a 43, and is finish rolled at 44.

In FIG. 16, continuous casting at 45 and high reduction extrusion at 48 are continuously carried out. Namely, the blank coming from the continuous casting machine is immediately soaked at 46, and is scarfed at 47 and then is subjected to the high reduction extrusion at 48 and finish rolling at 49.

The present invention is not limited to iron but is employed for non-ferrous metal, and when it is used in the rough rolling stage in the manufacturing process for steel, extremely good effects can be obtained.

What is claimed is:

1. A metal extrusion process for producing a shaped steel product having a sharply angled corner portion by high reduction of a workpiece, comprising:

disposing a plurality of work rolls to form a completely enclosed rotary die;

disposing a forming die at said rotary die, said forming die having an inlet with a cross-sectional shape the same as the cross-sectional shape of the workpiece to be extruded and tapering from said inlet and to said rotary die and having portions which fill the gaps between end portions of said work rolls on the input side of said rotary die;

feeding a metal workpiece which is at a rolling temperature into a guide container means connected to the forming die and having the cross-sectional shape of the workpiece to be extruded; and exerting a force on the workpiece for urging it through said guide container means toward said rotary die and through said die and driving said rolls for extruding the metal workpiece continuously through the rotary die.

2. A metal extrusion process as claimed in claim 1 in which said force is a pushing force.

3. A metal extrusion process as claimed in claim 1 in which said force is a combined pushing and tensile force, the tensile force being from 0.01 to 1.0 times the yield stress of the metal at the rolling temperature.

4. A metal extrusion process as claimed in claim 1 further comprising adjusting ratio of the peripheral speed of rolls ($v/V$) so that it is in the range of ($v/V \leqq (v/V)^*$, where $(v/V)^*$ is the ratio of the peripheral speed v of the rolls to the speed V of the workpiece coming from the rotary die at the time when underfill starts at the corner portion of the cross-section of the workpiece by increasing the peripheral speed $v$ of the work rolls relative to the speed $V$ of the workpiece coming from the rotary die, whereby the radius of curvature or chamber of the corner portion of the product can be controlled so that it is a desired shape.

5. A metal extrusion process as claimed in claim 4 wherein the ratio of the peripheral speed of the rolls is controlled to satisfy the following formulae.

$$\left(\frac{v}{V}\right)^* \leqq \frac{v}{V} \leqq \left(\frac{v}{V}\right)^{**},\ \frac{b}{a} = -A + \frac{B}{\frac{v}{V} + C}$$

$$\left(\frac{v}{V}\right)^{} < \frac{v}{V},\ \frac{b}{a} = \left(\frac{b}{a}\right)^{}$$

where a: length of the side of the rolled workpiece;

*b:* length of underfill at the corner of product in the direction of the side of the rolled workpiece;

$(v/V)^{**}$: ratio of the peripheral speed v of rolls to the speed of the rolled workpiece when length b of underfill at the corner of the workpiece starts to be independent of the ratio of the peripheral speed of the rolls as the ratio $v/V$ is gradually increased;

A, B, C : constants dependent on rolling conditions of elongation, roll diameter, friction coefficient, and have values in the following ranges:

$0 \leqq A \leqq 1.0$ $0 \leqq B \leqq 1.0$ $-1.0 \leqq C \leqq 0.$

6. A metal extrusion process as claimed in claim 4 further comprising detecting a deviation $\Delta b$ from a target value of the amount b of underfill at the corner of the rolled workpiece and detecting the speed V during the rolling, obtaining a correction $\Delta v$ in peripheral speed of work rolls according to the formulae:

$$\left(\frac{v}{V}\right)^* \leqq \left(\frac{v}{V}\right) \leqq \left(\frac{v}{V}\right)^{**},\ \Delta v = -\frac{V}{B}\left(\frac{v}{V} + C\right)^2 \frac{\Delta b}{a}$$

$$\text{and } \left(\frac{v}{V}\right)^* < \frac{v}{V},\ \Delta v = 0$$

where A, B and C are constant dependent on rolling conditions of elongation, roll diameter, and friction coeficient, and have values in the following ranges:

$0 \leqq A = 1.0$ $0 \leqq B \leqq 1.0$ $-1.0 \leqq C \leqq 0;$ controlling the deviation of the amount of underfill by feeding back the amount of $\Delta v$ until the difference $\Delta b$ from the target value is zero.

* * * * *